United States Patent [19]

Berchem

[11] Patent Number: 4,634,062

[45] Date of Patent: Jan. 6, 1987

[54] FORGED STEEL GRINDING ELEMENT FOR BALL MILLING

[75] Inventor: Rütger Berchem, Gelsenkirchen, Fed. Rep. of Germany

[73] Assignee: Berchem & Schaberg GmbH, Gelsenkirchen, Fed. Rep. of Germany

[21] Appl. No.: 667,284

[22] Filed: Nov. 1, 1984

[30] Foreign Application Priority Data

Nov. 2, 1983 [DE] Fed. Rep. of Germany ..... 3339550

[51] Int. Cl.[4] ..... B02C 17/20

[52] U.S. Cl. ..... 241/184; 241/291

[58] Field of Search ..... 241/30, 26, 284, 184, 241/170, 291, 24

[56] References Cited

U.S. PATENT DOCUMENTS

| | | | |
|---|---|---|---|
| 2,069,731 | 2/1937 | Trumpler | 241/24 |
| 2,310,987 | 2/1943 | Noderer et al. | 241/184 X |

FOREIGN PATENT DOCUMENTS

| | | | |
|---|---|---|---|
| 14655 | 8/1980 | European Pat. Off. | 241/184 |
| 3339550 | 10/1984 | Fed. Rep. of Germany . | |
| 21030 | 2/1978 | Japan | 241/184 |

*Primary Examiner*—Mark Rosenbaum

*Attorney, Agent, or Firm*—Karl F. Ross; Herbert Dubno

[57] ABSTRACT

A forged grinding element made of steel for ball milling consisting of a steel alloy containing from 0.7 to 1.0 weight percent of manganese; 0.7 to 2.2 weight percent of chromium; 0.3 to 0.6 weight percent of molybdenum, 0.5 to 2.2 weight percent of nickel and up to 0.45 weight percent of carbon, the balance iron with the usual steel impurities. This alloy has high hardness and a basic tensile strength amounting to 1300 to 1700 N/mm$^2$. Its shape is round or polygonal such as pyramid shaped.

2 Claims, 4 Drawing Figures

FORGED STEEL GRINDING ELEMENT FOR BALL MILLING

FIELD OF THE INVENTION

My present invention relates to forged grinding elements made of steel and intended for use in ball mills.

BACKGROUND OF THE INVENTION

Ball milling, which is especially useful in milling clinker for the production of cement, uses a rotary vessel into which the clinker is introduced and which contains a multiplicity of grinding elements which tumble with the clinker and thereby comminute it. The powdered product is separated from the grinding elements by, for example, screening. The grindihg elements hitherto used for this purpose are balls of a steel alloy with a high content of over 0.45 weight percent carbon. These steel alloys and especially their carbon content are so selected that the resulting grinding balls can be subjected to a hardening process and exhibit, as a result, considerable hardness. The diameters of the balls are chosen for the particular milling result desired. On one hand they must produce a milled product having optimum quality and on the other hand they must undergo a minimum of attrition so that the attrition dose not contaminate the resulting milled product The purity of the product should be if possible quantitative. The grinding balls heretofore in use inevitably undergo certain amount of attrition and must be replaced frequently.

OBJECTS OF THE INVENTION

The principal object of the invention is to provide an improved grinding element for ball-type mills whereby the disadvantages of earlier grinding elements can be obviated.

Another object of the invention is to provide an improved method of making a grinding element.

SUMMARY OF THE INVENTION

These objects and others which will become apparent hereinafter are attained as a result of my discovering that milling elements forged from a certain steel alloy have practically no attrition or at worst a minimum attrition so that the use of these elements in ball-mill grinding greatly improves the quality of the product.

The steel alloy which is used has the following composition:

- 0.7 to 1.0 percent by weight manganese,
- 0.7 to 2.2 percent by weight chromium,
- 0.3 to 0.6 percent by weight molybdenum,
- 0.5 to 2.2 percent by weight of nickel and up to 0.45 percent by weight carbon, the balance iron with the usual steel impurities, i.e. substantially iron. This alloy has a basic tensile strength of 1300 to 1700 N/mm$^2$. The grinding elements according to the invention differ from conventional steel products by their reduced carbon content with the result that the material is harder than the previously known materials.

A preferred embodiment of the invention has a basic tensile strength of 1400 to 1600 N/mm$^2$ and having been austenized i.e. heated to austenization temperature and quenched in oil with possible additional tempering or ageing.

To reduce the attrition the core of the element can be comparatively soft or ductile while the surface should be especially hard and according to the invention this hardness should range from 55 to 60HRC. This hardness can be achieved with the steel alloy of the invention by the conventional surface hardening techniques.

In accordance with the invention, the grinding element can be forged to the final shape, which can be a ball, from castings of the above alloy.

Surprisingly this form, hitherto considered standard, can be dispensed without damage to the milled product and without deleterious increase in the amount of attrition when the elements are polygonal in configuration. The milled product can be improved by the use of the present grinding element which has a large attack surface. The grinding elements of the invention can assume a pyramid form or a double-pyramid form. They can also assume a cubic shape These shapes can be forged particularly effectively.

Among the advantages attained by the present inventi is a reduction of attrition in a milling process so that the milled product is more uniform. According to the invention a grinding element can be especially made for ball milling in which the quality of the milled product is improved with respect to its purity. Surprisingly in accordance with the invention the attrition is reduced by half.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
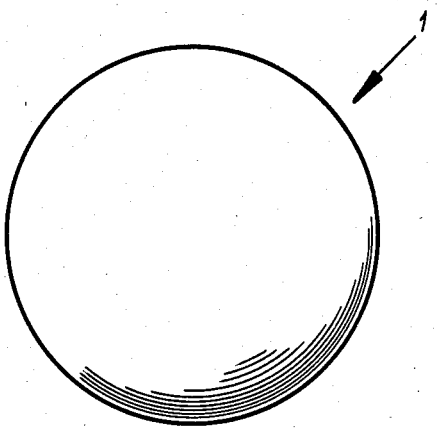
FIG. 1 is an elevational view showing one embodiment of the invention.

The grinding body 1, 1*a* or 1*b* according to the invention is forged from steel of the previously described composition. This body has a high surface hardness and a basic tensile strength of 1300 to 1700 N/mm$^2$; in FIG. 1 the body 1 is spherical.

Figure 3:
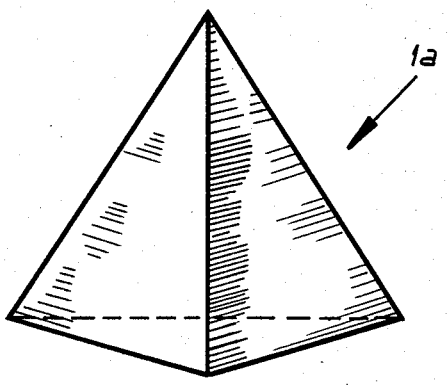
FIG. 3 is a perspective view of another embodiment of the invention.
Figure 4:
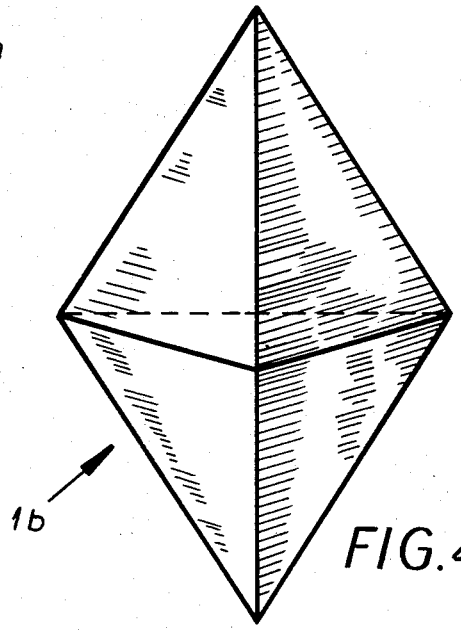
FIG. 4 is a perspective view of yet another embodiment of the invention.

In the embodiment of FIG. 3 the body 1*a* has the form of a pyramid while in the embodiment of FIG. 4 it has the shape of a double pyramid.

Figure 2:
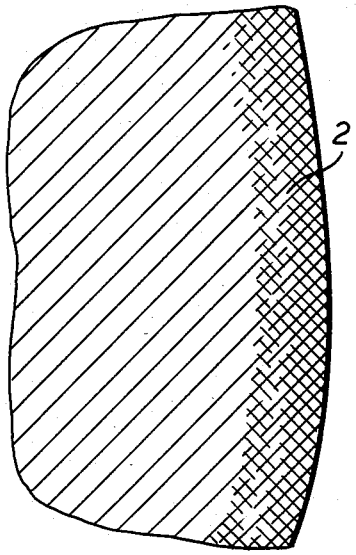
FIG. 2 is a cross sectional view taken through FIG. 1.

In FIG. 2 a cross section of a grinding element according to the invention has a hardened surface 2 whose hardness lies between 55 to 60 HRC. The basic tensile strength thereof is obtained through austenitizing and quenching oil and, optionally by case hardening.

The present invention is further illustrated by the following examples.

EXAMPLE 1

The spherical grinding element 1 was prepared from an alloy containing 0.75% by weight manganese, 0.75% by weight chromium, 0.35% by weight molybdenum, 0.55% by weight of nickel and 0.20% by weight carbon, balance substantially iron.

EXAMPLE 2

The double pyramid grinding element for ball milling was prepared from 0.95% by weight manganese, 2.1 weight percent chromium, 0.55 weight percent molybdenum, 2.1 weight percent nickel and 0.40 weight percent carbon, balance substantially iron.

The grinding elements prepared in Examples 1 and 2 were found suitable in actual use in the milling of clinker for cement.

I claim:

1. A forged steel grinding element for tumble milling comprising:

0.75 wt % manganese,
0.75 wt % chromium,
0.35 wt % molybdenum,
0.55 wt % nickel,
up to 0.20 wt % carbon, and
the balance iron with conventional steel impurities, said grinding element having a basic tensile strength of 1300 to 1700 $N/mm^2$.

2. A forged steel grinding element for tumble milling comprising:

0.95 wt % manganese,
2.1 wt % chromium,
0.55 wt % molybdenum,
2.1 wt % nickel,
up to 0.40 wt % carbon, and
the balance iron with conventional steel impurities, said grinding element having a basic tensile strength of 1300 to 1700 $N/mm^2$.

* * * * *